United States Patent [19]

Faure et al.

[11] Patent Number: 4,995,920

[45] Date of Patent: Feb. 26, 1991

[54] PROCESS FOR THE PRODUCTION OF ALUMINUM ALLOYS BY SPRAY DEPOSITION

[75] Inventors: Jean-Francois Faure, Voiron; Bruno Dubost, Maison Lafitte, both of France

[73] Assignee: Pechiney Recherche Groupement D'Interet Economique, Paris, France

[21] Appl. No.: 450,525

[22] Filed: Dec. 14, 1989

[30] Foreign Application Priority Data

Dec. 19, 1988 [FR] France ..... 88 17044

[51] Int. Cl.[5] ..... B22F 1/00

[52] U.S. Cl. ..... 148/12.7 A; 148/2; 148/3; 148/159; 148/415; 148/416; 148/417; 148/418

[58] Field of Search ..... 148/2, 3, 12.7 A, 159, 148/415–418

[56] References Cited

U.S. PATENT DOCUMENTS 3,563,814 2/1971 Lyle et al. ..... 148/12.7 A

*Primary Examiner*—R. Dean

*Assistant Examiner*—David W. Schumaker

*Attorney, Agent, or Firm*—Dennison, Meserole, Pollack & Scheiner

[57] ABSTRACT

A process for the production of a series 7000 aluminum alloy (Al-Zn-Cu-Mg) with a high level of mechanical strength and good ductility, by spray deposition. The object is the production of aluminum alloys having an ultimate stress $\geqq$ 800 MPa and an elongation $\geqq$ 5%, as well as the production of alloys which are reinforced by ceramic particles. According to the process, a solid alloy is formed by spray deposition, the alloy is transformed in the hot condition at between 300° and 450° C. and possibly in the cold condition, and the transformed alloy is subjected to solution treatment, quenching and aging.

11 Claims, No Drawings

PROCESS FOR THE PRODUCTION OF ALUMINUM ALLOYS BY SPRAY DEPOSITION

The invention concerns a process for the production of an Al alloy in the series 7000 (Al—Zn—Cu) with a high level of mechanical strength and good ductility by "spray deposition". More precisely the process aims to produce Al alloys which in the treated state (T6 ) have an ultimate stress ≧800 MPa with an elongation at least in the lengthwise direction of greater than or equal to 5%.

The invention also concerns the production of composite materials with a very high level of strength, high rigidity and good ductility, the matrix of which comprises the above-described alloys 7000 with a particular reinforcement of ceramic materials, obtained directly by "spray deposition".

A great deal of work has already been carried on in relation to alloys in the series 7000, which are charged with alloying elements in order to achieve high levels of mechanical strength in association with good ductility, either by means of conventional metallurgy or by means of powder metallurgy.

Thus, in the former case, we are aware of French patents Nos. Fr 2 517 702 or FR 2 457 908 setting forth alloys in the series 7000 which do not exceed an ultimate stress of 650 to 700 MPa approximately, with an elongation of the order of 8 to 9% (in the lengthwise direction).

Attempts have also been made to produce alloys in the series 7000 with a high level of strength by means of powder metallurgy, that is to say by means of a process comprising the formation of particles (powders, grains, flakes, crushed strip, etc. . . ) which are then consolidated in solid form by various methods (hot, cold or isostatic compression, extrusion, etc. . . ).

However, although those alloys attain high or very high levels of mechanical strength, they suffer from very low degrees or elongation, which prevent them from being put to any industrial use.

Thus, HAAR reports in Alcoa Report No. 13-65-AP59-S- contract No. DA-360-034-ORD-3559 RD (Frankfort Arsenal), May 1966 ultimate tensile stresses exceeding 800 MPa but with degrees of elongation of the order of 1%. Likewise BOWER et al—Met. Trans. Vol. 1, January 1970, page 191, reports, in relation to alloys of the same family which are produced by "splat cooling" (hammer and anvil method), ultimate stresses of 800 MPa but with degrees of elongation of 2%.

U.S. Pat. Nos. 3,563,814 and 4,732,610 relate to alloys in the same family which are produced by powder metallurgy but the mechanical characteristics of which are markedly inferior to the aims envisaged ultimate stress of the order of 500 MPa to 600 MPa.

The invention therefore comprises:

1. forming by spray deposition a solid alloy of the following composition by weight:

| | |
|---|---|
| Zn | 8.5 to 15% |
| Mg | 2.0 to 4.0% |
| Cu | 0.5 to 2.0% |

at least one of the following 3 elements:

| | |
|---|---|
| Zr | from 0.05 to 0.8% |

-continued

| | |
|---|---|
| Mn | from 0.05 to 1.0% |
| Cr | from 0.05 to 0.8% |
| with Zr + Mn + Cr ≦ 1.4% | |
| Fe | up to 0.5% |
| Si | up to 0.5% |
| Others | |
| (impurities) | ≦ 0.05% each |
| | ≦ 0.15% in total |
| Balance Al, | |

2. transforming in the hot condition the body which is obtained in that way at between 300 and 450° C. and optionally in the cold condition, and
3. carrying out a heat treatment on the product obtained by solution treatment, quenching and ageing.

The term "spray deposition" is used to denote a process in which the metal is melted, atomised by a jet of gas at high pressure in the form of fine liquid droplets which are then directed and agglomerated on a substrate so as to form a solid coherent deposit containing a low degree of open porosity. The deposit may be in the form of billets, tubes or plates, of a controlled geometry. A procedure of that type is referred to in English as "spray deposition" and is also referred to as the "OSPREY process". The latter process is primarily described in the following patent applications or patents: GB-B-1 379 261; GB-B-1 472 939; GB-B-1 548 616; GB-B-1 599 392; GB-A-2 172 827; EP-A-225 080; EP-A-225 732; and WO-A-87-03012.

The best mechanical characteristics (Rm≧800 MPa, El (elongation) ≧5%) are obtained with the composition indicated above.

If Zn≧8.5% by weight, the fraction by volume of precipitates forming the basis for structural hardening of the alloy (essentially of the type $\eta$-Mg $Zn_2$ or $\eta'$-(Mg, Zn, Al, Cu)) becomes insufficient and it is no longer possible to achieve the high levels of mechanical characteristics (such as a ultimate stress≧800 MPa) which are the aim of the present invention.

Likewise, if the amount of Zn exceeds 15% by weight, the fraction by volume of the second phase is too high and results in a brittle material with very low levels of elongation to fracture, which prevents it from being put to industrial use.

Within the range of from 8 to 15% by weight of zinc, the amounts of copper and magnesium must be in proportions which are close to the stoichiometry of the hardening precipitates. In practice it is found that when Mg<2% or Cu<0.5%, the nature and the fraction by volume of the precipitates formed are insufficient to attain the desired mechanical characteristics. When in contrast Mg≧4% or Cu≧2.0%, those elements are present in excess in the alloy and impart considerable fragility thereto.

The presence of Cr, Zr and Mn, alone or in association, give rise to a supplementary hardening action, either due to a fibring effect by preventing or limiting recrystallisation which may occur when carriyng out the heat treatment following the operations for transformation of the material by working thereof, or by virtue of a mechanism involving hardening by dispersion, having regard to the fact that those elements in combination with aluminium form dispersed, fine and well-distributed phases (for example $Al_3Zr$, $Al_6Mn$ or ternary phases $Al_{18}Cr_2$ $Mg_3$ and (Al, Cr, Mn)). However the content thereof is to be limited to 0.8% in respect of Cr and Zr and 1.0% in respect of Mn and their overall content (Zr+Cr+Mn)≦1.4% as beyond that the dispersed phases formed are excessively numerous and excessively coarse and consequently cause the material to become fragile. In addition amounts of Cr, Zr, and Mn of higher than the above-indicated limits result in the alloys having elevated liquidus temperatures, which gaves rise to problems in production, which are linked in particular to sublimation of the zinc or magnesium. The amounts of iron and silicon are limited upwardly to 0.5% as above that limit coarse intermetallic compounds are formed, which are detrimental to the ductility of the alloy.

The preferential composition is as follows:

| | |
|---|---|
| Zn | from 8.7 to 13.7% |
| Mg | from 2.2 to 3.8% |
| Cu | from 0.6 to 1.6% |
| at least one of the following 3 elements: | |
| Zr | from 0.05 to 0.5% |
| Mn | from 0.05 to 0.8% |
| Cr | from 0.05 to 0.5% |
| with Zr + Mn + Cr ≦ 1.2% | |
| Fe | up to 0.3% |
| Si | up to 0.2% |
| others | |
| (impurities) | ≦ 0.05% each |
| | ≦ 0.15% total |
| balance Al. | |

In order to achieve better results, the amount of principal elements preferably complies with the following relationship:

$$5.5 \leqq Mg + Cu + \frac{Zn}{6} \leqq 6.5$$

It is in fact in that range of composition that the fraction by volume of hardening phases is at a maximum while permitting complete solution of the additive elements in the course of the heat treatment.

It is thus that it is possible to achieve a very high level of mechanical strength while maintaining good ductility.

As regards the effect of the elements forming dispersoids (Zr, Cr, and Mn), it has been realised that it was preferable for all three thereof to be used in association, rather than one or the other separately. In fact, for a given overall content of Zr+Cr+Mn, the result is a distribution of finer and better distributed dispersoids when the three elements are present simultaneously rather than when there is only one or two of the three. When the three elements are associated, it is however desirable to limit their overall content to 1.2%. More precisely it is found that, for an identical amount, Zr, results in the formation of dispersoids ($Al_3Zr$) which are finer and better distributed than those formed from Cr or Mn; therefore, when the ductility and toughness of the alloy are to be maximised, it is necessary to limit the amount of Mn+Cr to 0.6% maximum.

Hot transformation of the solid alloy obtained by spray deposition generally takes place at between 300° and 450° C., preferably by extrusion, forging or rolling, in one or more successive operations; those operations may possibly be combined, for example extrusion+rolling or extrusion+forging/stamping.

The hot transformation operations may be completed by cold operations such as rolling, drawing, etc. The solution treatment is carried out at between 440° and 520° C., for a period of between 2 and 8 hours, depending on the size of the products; the quenching operation is followed by an ageing operation for between 2 and 25 hours at between 90° and 150° C. at one or more plateaux, the longest times generally being associated with the lowest temperatures (and vice-versa). The product obtained by a spray deposition process may possibly be homogenised prior to hot transformation at between 450° and 520° C. for a period of from 2 to 50 hours at one or more plateaux.

Using the alloys and the method described hereinbefore, the invention also involves producing composite materials with a very high level of strength (Rm≧800 MPa), with a high Young's modulus (E≧80 GPa), with a level of ductility which is acceptable to users (El≧3%), and a good level of resistance to wear and friction. Those materials are characterised by a matrix of alloy in the series 7000 of the above-indicated composition and a dispersion of ceramic particles of type SiC, $Al_2O_3$ or $B_4C$ (those examples not being limitative) and are produced directly by the spray deposition procedure.

The invention therefore comprises:

(1) Melting and spraying an alloy 7000 of the above-described composition, (2) Co-injecting into the jet of atomised metallic droplets ceramic particles of type SiC, $Al_2O_3$, $B_4C$ or other carbides, nitrides or oxides or combination thereof, of substantially equiaxis shape and of a size of between 1 μm and 50 μm and in a fraction by volume relative to the metal of between 3 and 28%. The term size is used to denote the overall maximum dimension of the particle, (3) Agglomerating the jet of metallic and ceramic particles in the form of a solid metal by the spray deposition procedure, and (4) Transforming and subjecting to heat treatment the deposit which is obtained in that way by means of a procedure similar to that described in respect of the foregoing non-reinforced alloys 7000.

The invention will be better by means of the following Examples:

EXAMPLE 1

Different alloys referenced 1 to 7, the compositions of which are set forth in Table 1, were melted and produced by spray deposition (OSPREY process) in the form of cylindrical billets measuring 150 mm in diameter under the following conditions:

pouring temperature: 750° C.

atomiser-deposit distance: 600 mm, maintained substantially constant throughout the test collector of stainless steel, displaced with a rotational movement, oscillation of the atomiser with respect to the axis of rotation of the collector.

The atomisation gas flow rates and the metal flow rate used for each composition are also set forth in Table 1.

After being skimmed down to 140 mm, the billets are homogenised for 8 hours at the temperature specified in Table 1.

The blanks are then subjected to hot extrusion at 400° C. in a press, the container of which is of a diameter of 143 mm, in the form of flat portions of a section measuring 50×22 mm, that is to say, with an extrusion ratio of 14.6. The flat portions obtained in that way are then subjected to solution treatment at the temperature specified in Table 1 for a period of 2 hours, quenched with cold water and then aged for a period of 24 hours at 120° C. The mechanical tensile characteristics in the lengthwise direction, being the average of three tests, are set out in Table 2 (R 0.2: elastic limit at 0.2% of residual deformation, Rm: ultimate stress; E1%: elongation to fracture).

It is found that alloys Nos. 1 to 4 according to the invention have a very high level of mechanical characteristics with in particular an ultimate stress≧800 MPa as well as a correct level of ductility, with degrees of elongation to fracture≧5%.

Alloy No. 5 which is outside the analytical limits of the invention (excessively low amount of Zn) has mechanical characteristics which are markedly poorer than the alloys of the invention.

Alloy No. 6 which is also outside the limits of the invention by virtue of its excessively high content of Zn has very low levels of ductility (E1%) and plastic domain (Rm—R0.2).

Alloy No. 7 is also outside the scope of the invention by virtue of its total content of Zr+Cr+Mn being too high. In spite of the good level of mechanical characteristics, that is manifested by a very low level of ductility (elongation to fracture=2%).

It is therefore clear that a markedly superior array of properties is obtained within the analytical framework of the invention in respect of alloys produced by the spray-deposition process.

Alloy No. 8 is an alloy whose composition falls within the analytical range of the alloys of the invention but which was prepared using a powder metallurgy method as described hereafter: the alloy is melted and then atomised using nitrogen in the form of powders; the powders are recovered and sieved to a size of 100 μm. The powders of a smaller size than 100 μm are put into aluminium containers of a diameter of 140 mm provided with an orifice tube and then are degassed in the hot condition under a secondary vacuum (by pumping through the tube) at a temperature of 460° C. for a period of 100 hours. The containers of powder degassed in that way welded sealed and then compressed in the hot condition in an extrusion press with a blind die in a container measuring 143 mm in diameter at 450° C. so as to attain the theoretical density of the material. The billets which are obtained in that way are then machined in order to remove the material of the container and then extruded under the same conditions as the billets of the preceding Examples. The product obtained is subjected to heat treatment using a similar procedure (see the solution treatment temperature in Table 1) and is characterised under the same conditions.

The results which are set forth in Table 1 show that the product obtained has a very low level of ductility and plastic domain spite of a relatively high level of strength.

The case of the last alloy clearly illustrates the superiority of the method of the invention for the production of alloys which have both very levels of strength and good ductility.

EXAMPLE 2

An Al alloy of the following composition:

Al: 10% Zn; 3.0% Mg; 1.0% Cu; 0.1% Zr; 0.15% Cr; 0.15% Mn, balanced Al was melted at 750° C. and produced by spray deposition in the form of billets measuring 150 mm in diameter with the simultaneous co-injection of particles of SiC of a mean size of 10 μm, with a fraction by volume of 15%.

The spray deposition conditions were as follows:

metal flow rate: 5.8 kg/min gas flow rate: 15 Nm3/min atomiser-deposit distance: 620 mm, maintained substantially constant throughout the test stainless steel collector displaced with a rotational movement and oscillation of the atomiser with respect to the axis of rotation of the collector.

The billets obtained in that way are then skimmed down to a diameter of 140 mm, homogenised for 8 hours at 470° C., and subjected to hot extrusion at 400° C. in the form of flat members of a section measuring 50×22 mm (extrusion ratio 14.6).

The flat members are subjected to a heat treatment under the following conditions:

solution treatment at 470° C. for 2 hours quenching with cold water aging at 120° C. for 24 hours.

The tensile characteristics and the Young's modulus (E) were measured in the lengthwise direction. The results obtained, being the average of three tests, are set out below:

R 0.2=798 MPa, Rm=820 MPa, E1=4% and E=95 GPa.

The spray deposition process according to the invention, besides the improved comprimise in regard to the mechanical characteristics attained, has the following advantages over conventional powder metallurgy:

the long and expensive degassing and compacting operations are avoided, and the method is safer as it does not involve handling reactive powders.

TABLE 1

| ALLOY NO | COMPOSITION (% BY WEIGHT) Zn | Mg | Cu | Mn | Cr | Zr | Al | PRODUCTION PROCESS | GAS FLOW RATE (m3/min) | METAL FLOW RATE (kg/min) | HOMOGENISATION TEMPERATURE (°C.) | SOLUTION TREATMENT TEMPERATURE (°C.) |
|---|---|---|---|---|---|---|---|---|---|---|---|---|
| 1 | 12.0 | 3.0 | 1.0 | 0.25 | 0.20 | 0.20 | bal. | Spray deposition | 15 | 6.0 | 470 | 470 |
| 2 | 13.0 | 2.5 | 1.4 | 0.20 | 0.15 | 0.20 | " | Spray deposition | 14 | 5.8 | 465 | 465 |
| 3 | 14.5 | 2.2 | 1.1 | 0.15 | 0.10 | 0.30 | " | Spray deposition | 16 | 6.1 | 460 | 460 |
| 4 | 9.0 | 3.5 | 1.2 | 0.25 | 0.15 | 0.25 | " | Spray deposition | 12 | 5.6 | 470 | 470 |
| 5 | 8.0 | 2.5 | 1.6 | 0.25 | 0.20 | 0.20 | " | Spray deposition | 12 | 6.0 | 470 | 470 |
| 6 | 16.0 | 3.2 | 1.0 | 0.20 | 0.15 | 0.22 | " | Spray deposition | 16 | 5.8 | 460 | 460 |
| 7 | 12.2 | 2.9 | 1.1 | 0.7 | 0.5 | 0.6 | " | Spray deposition | 14.8 | 6.1 | 470 | 470 |

TABLE 1-continued

| ALLOY NO | COMPOSITION (% BY WEIGHT) Zn | Mg | Cu | Mn | Cr | Zr | Al | PRODUCTION PROCESS | GAS FLOW RATE (m3/min) | METAL FLOW RATE (kg/min) | HOMOGENISATION TEMPERATURE (°C.) | SOLUTION TREATMENT TEMPERATURE (°C.) |
|---|---|---|---|---|---|---|---|---|---|---|---|---|
| 8 | 12.1 | 2.9 | 1.0 | 0.20 | 0.20 | 0.15 | " | Powder metallurgy | — | — | — | 470 |

TABLE 2

| ALLOY | R 0.2 (MPa) | Rm (MPa) | El (%) |
|---|---|---|---|
| 1 | 790 | 810 | 8.0 |
| 2 | 792 | 812 | 7.0 |
| 3 | 795 | 809 | 6.0 |
| 4 | 785 | 805 | 9.0 |
| 5 | 710 | 755 | 9.0 |
| 6 | 765 | 768 | 1.2 |
| 7 | 795 | 802 | 2.0 |
| 8 | 791 | 793 | 0.5 |

We claim:

1. A process for the production of alloys of Al in the series 7000 with a high level of strength and good ductility, comprising the steps of:

(a) forming, by spray deposition, a solid alloy consisting essentially of, by weight:

| | |
|---|---|
| Zn | from 8.5 to 15.0% |
| Mg | from 2.0 to 4.0% |
| Cu | from 0.5 to 2.0% |

at least one of the elements selected from the group consisting of Zr, Mn and Cr in the amounts:

| | |
|---|---|
| Zr | from 0.05 to 0.8% |
| Mn | from 0.05 to 1.0% |
| Cr | from 0.05 to 0.8% |
| with Zr + Mn + Cr ≦ 1.4% | |
| Fe | up to 0.5% |
| Si | up to 0.5% |
| others (impurities) | ≦ 0.05% each<br>≦ 0.15% total |
| balance Al; | |

(b) subjecting said solid alloy to transformation in the hot condition at between 300° and 450° C. and optionally in the cold condition, and (c) subjecting said transformed alloy to heat treatment by solution treatment, quenching and ageing.

2. A process according to claim 1 wherein the alloy composition is:

| | |
|---|---|
| Zn | from 8.7 to 13.7% |
| Mg | from 2.2 to 3.8% |
| Cu | from 0.6 to 1.6% |

at least one of the elements:

| | |
|---|---|
| Zr | from 0.05 to 0.5% |
| Mn | from 0.05 to 0.8% |
| Cr | from 0.05 to 0.5% |
| with Zr + Mn + Cr ≦ 1.2% | |
| Fe | up to 0.3% |
| Si | up to 0.2% |
| others (impurities) | ≦0.05% each<br>≦0.15% total |
| balance Al. | |

3. A process according to claim or wherein the amounts of Mg, Cu and Zn expressed in percentages by weight comply with the relationship:

$$5.5 \leqq Mg + Cu + \frac{Zn}{6} = 6.5$$

4. A process according to claim 1 or claim 2 wherein Cr, Zr and Mn are present simultaneously in the composition of the alloy, with:

Cr≧0.05%, Mn≧0.05%, Zr≧0.05% and Mn+Cr+Zr≦1.2%.

5. A process according to claim 4 wherein the composition of the alloy is such that:

Mn+Cr≦0.6%.

6. A process according to claims 1 or 2 wherein a homogenisation operation at between 450° and 520° C. for a period of 2 to 50 hours is carried out between steps (a) and (b).

7. A process according to claim 1 or 2 wherein the hot transformation operation is effected by extrusion, rolling or forging or a combination thereof.

8. A process according to claim 7 wherein the hot transformation operation is followed by a cold tranformation operation.

9. A process according to claim 1 or 2 wherein the solution treatment is effected at between 440° and 520° C. for a period of from 2 to 8hours.

10. A process according to claim 1 or 2 wherein the aging operation is effected at between 90° and 150° for a period of from 2 to 25 hours.

11. A process for the production of composite materials with a metallic matrix wherein a solid alloy is produced in accordance with claim 1 or 2 wherein during the spray deposition operation ceramic particles of substantially equiaxis shape, of a size of between 1 and 50 μm and in a fraction by volume "relative to the metal" of between 3 and 28% are co-injected.

* * * * *